US006390702B1

(12) United States Patent
Müller

(10) Patent No.: US 6,390,702 B1
(45) Date of Patent: May 21, 2002

(54) APPARATUS FOR PROCESSING AND TRANSFERRING MAIL

(75) Inventor: Dietrich Müller, Berlin (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

(21) Appl. No.: 09/391,718

(22) Filed: Sep. 8, 1999

(30) Foreign Application Priority Data

Sep. 8, 1998 (DE) ..... 198 40 917

(51) Int. Cl.[7] ..... B41J 13/02
(52) U.S. Cl. ..... 400/636; 271/2
(58) Field of Search ..... 400/636, 613, 400/48, 635; 101/368, 47, 91; 347/4, 154, 23; 271/185

(56) References Cited

U.S. PATENT DOCUMENTS

| | | | | |
|---|---|---|---|---|
| 4,974,828 A | | 12/1990 | Matsuo et al. | |
| 5,251,425 A | * | 10/1993 | Kern | 53/460 |
| 5,295,674 A | * | 3/1994 | Zoltner | 271/2 |
| 5,470,182 A | * | 11/1995 | Krupotich et al. | 409/137 |
| 5,498,114 A | * | 3/1996 | Gregoire et al. | 414/21 |
| 5,684,705 A | * | 11/1997 | Herbert | 364/464 |
| 5,800,119 A | * | 9/1998 | Biggadike | 414/757 |
| 5,880,747 A | | 3/1999 | Bartenwerfer et al. | |
| 6,280,104 B1 | * | 8/2001 | Muller et al. | 400/48 |

FOREIGN PATENT DOCUMENTS

| | | |
|---|---|---|
| DE | 196 05 014 C1 | 3/1997 |
| DE | 19705089 C1 | 3/1998 |
| DE | 197 05 089 C1 | 3/1998 |
| DE | 197 42 893 A1 | 4/1999 |

* cited by examiner

*Primary Examiner*—Daniel J. Colilla
*Assistant Examiner*—Darius N. Cone
(74) *Attorney, Agent, or Firm*—Laurence A. Greenberg; Werner H. Stemer; Ralph E. Locher

(57) ABSTRACT

An apparatus for processing and transferring mail includes a franking and/or addressing machine and a downstream depositing apparatus for depositing items of mail stackwise one above the other. The mail is transported continuously in the machine by a transporting belt and is printed by a contactless printing device, such as an ink-jet printing head being immobile during printing. A transporting roller over which the mail is guided is disposed in the machine immediately downstream of the belt at a sufficient distance from the printing head and is driven at a circumferential speed greater than that of the belt. An orthogonal distance between the roller and the printing head causes a course of the mail to be determined by the belt alone during printing. The apparatus improves functional properties, makes it possible for mixed mail to be deposited without complications and without changing existing depositing apparatuses and achieves a continuous throughflow of mail until an end of a printing operation and accelerated mail discharge thereafter. It considerably shortens a length of time until the mail is tipped into a depositing box and provides sufficient time for assuming a rest position with a surprisingly low technical outlay.

8 Claims, 8 Drawing Sheets

APPARATUS FOR PROCESSING AND TRANSFERRING MAIL

BACKGROUND OF THE INVENTION

Field of the Invention

The invention relates to an apparatus for processing and transferring mail, such as letters or envelopes and cards, including a franking and/or addressing machine and a downstream depositing apparatus in which the items of mail are deposited in a stackwise manner.

German Patent DE 196 05 014 C1 corresponding to U.S. Pat. No. 5,880,747 and German Patent DE 196 05 015 C1 corresponding to U.S. patent application Ser. No. 09/315,327, filed May 20, 1999 have disclosed a franking and/or addressing machine in which the letters or envelopes are transported continuously on edge and in such a manner that they butt against a rearwardly inclined guide plate, and are printed through the use of an ink-jet printing head that is immobile behind the guide plate during a printing operation. In that case, the letters or envelopes stand on a circulating transporting belt. A transporting speed of the letters or envelopes and a printing speed of the printing head are coordinated with one another.

A letter-depositing configuration which is intended for the above-described franking and/or addressing machine is also known from German Patent DE 197 05 089 C1. In that case, an insert is in alignment with the guide plate and is releasably connected to the franking machine. The insert opens out into a depositing box and is attached to a right-hand side wall of the franking machine. For that purpose, the right-hand side wall is provided with keyholes in which the insert is fitted by way of corresponding cap pins. The depositing box has a left-hand side wall guided between the insert and the right-hand side wall of the franking machine. A recess which is provided in a rear wall of the depositing box allows easy separation of the depositing box from the insert. The insert has a downwardly sloping channel, as seen in a transporting direction, and a rocker which can be pivoted resiliently parallel to a front edge of the insert and projects orthogonally upward in relation to the transporting direction. The channel adjoins a sliding surface for the bottom edge of the letters or envelopes in the franking and/or addressing machine.

Another configuration which is known from German Published, Non-Prosecuted Patent Application DE 197 42 893 A1 corresponding to U.S. patent application Ser. No. 09/161,200, filed Sep. 24, 1998, is intended for depositing recording media for the franking and/or addressing machine described above.

In that case, an angled insert with a downwardly sloping channel, as seen in the transporting direction, and a depositing box constructed as an angled part, are coupled releasably to a side of the franking machine. In a transition region to the channel, a sliding surface in the franking machine for the bottom edge of the letters or envelopes has a downwardly sloping configuration, as seen in the transporting direction, in a manner analogous to the channel. A terminating side wall of the depositing box is constructed as a resilient deflecting wall and is disposed at an adjustable distance downstream of the channel and orthogonally to the transporting direction. A distance between the side wall and an outlet of the franking machine is set to be somewhat greater than a letter or envelope format which is to be processed. In order to provide resilient properties of the side wall, the latter is separated from the front wall by a gap.

The two depositing apparatuses described above advantageously allow the processing of mixed mail, due to the upwardly open configuration and due to the letters or envelopes being transported on edge. Since, however, the base of the depositing box is usually disposed at the same height as the base of the franking machine, the stacking height is restricted accordingly. Added to that is the fact that the transporting speed of the letters or envelopes is only as great as the recording speed which the ink-jet printing head allows. The time provided for the emerging letter or envelope to slide down in the channel and to then tip into the depositing box is relatively brief, especially since the letter or envelope is braked during the sliding operation. It may thus be the case that the following letter or envelope comes into contact with the preceding one before the latter is lying flat. That may possibly lead to jamming.

On the other hand, U.S. Pat. No. 4,273,491 discloses a depositing apparatus in which the letters or envelopes slide down into a depositing box in the upright state in an elongate, downwardly sloping loading shaft that is closed on all sides and an additional pair of drive rollers is provided in the loading shaft. It is necessary for the pair of drive rollers to be capable of being adjusted resiliently with respect to one another for the purpose of adaptation to different letter or envelope thicknesses. The loading shaft has such a narrow configuration that mixed-mail processing is not possible.

SUMMARY OF THE INVENTION

It is accordingly an object of the invention to provide an apparatus for processing and transferring mail, which overcomes the hereinafore-mentioned disadvantages of the heretofore-known devices of this general type, which requires low outlay, which allows items of mixed mail to be deposited in a stackwise manner without complication, which permits existing suitable depositing apparatuses to be retained with as few changes as possible and which improves functional properties.

With the foregoing and other objects in view there is provided, in accordance with the invention, an apparatus for processing mail, such as letters, envelopes and cards, comprising a franking and/or addressing machine having a contactless printing device, such as an ink-jet printing head, for printing items of mail including a longest item to be expected, a transporting device disposed at a given height and circulating at a given circumferential speed for transporting the items of mail in a transporting direction, a transporting roller disposed immediately downstream of the transporting device in the transporting direction, the transporting roller disposed at the given height and driven at a circumferential speed higher than the given circumferential speed, the transporting roller spaced apart from the printing device by an orthogonal distance greater than the longest item to be expected, and a lower-level sloping region disposed downstream of the transporting device in the transporting direction for receiving the items of mail; and a depositing apparatus disposed downstream of the sloping region for receiving and depositing the items of mail stackwise one above the other.

In accordance with another feature of the invention, the transporting roller has a covering with a large coefficient of friction, for example polyurethane.

In accordance with a further feature of the invention, there is provided a rearwardly inclined guide plate against which the mail is transported on edge, the printing device disposed in the vicinity of the guide plate, and a sloping channel along which the mail slides down on edge in the transporting direction.

In accordance with an added feature of the invention, the sliding region has an inclination and shape for a bottom edge of letters or envelopes in the franking and/or addressing machine, the sloping channel has an inclination and shape, and the inclinations and shapes of the sliding region and the sloping channel are adapted to one another.

In accordance with an additional feature of the invention, the depositing apparatus includes an insert and a depositing box, the sloping channel is part of the insert, and the depositing box is adjustable relative to the insert for adaptation to a largest letter or envelope format.

In accordance with a concomitant feature of the invention, the sliding region has a given inclination and shape, the mail is transported horizontally on the transporting belt, the printing device is disposed above the transporting belt, and the depositing apparatus includes a depositing box having a left-hand side wall adapted to the given inclination and shape and a right-hand side wall constructed as a deflecting wall.

Since the individual letter or envelope, following completion of the printing operation and subsequent to transportation on the transporting device, is directed over a driven transporting roller having a circumferential speed which is greater than the circumferential speed of the transporting device, the letter or envelope is accelerated once it leaves the transporting device. Consequently, on one hand, this considerably shortens the length of time until the depositing box is reached and, on the other hand, sufficient time is correspondingly provided for the letter or envelope to be able to tip into the rest position before the next-following letter or envelope arrives.

Since the distance between the transporting roller and the ink-jet printing head is set to be greater than the longest print or printed item which is to be expected, the course of the letters or envelopes is determined exclusively by the transporting device until the printing operation is terminated.

Since the letter or envelope is guided over the transporting roller either on edge or horizontally and is driven by the transporting roller merely due to its weight and the coefficient of friction of the peripheral roller material, adaptation to different letter or envelope thicknesses is not necessary.

The outlay for the additional drive is surprisingly low. Thus, the transporting roller can be driven by the same motor which drives the transporting device, by using a corresponding transmission through a belt.

The frictional locking between the letter or envelope and the transporting roller prevents overloading. The transporting roller can run continuously, with the result that an additional control outlay is dispensed with.

Existing letter or envelope-depositing apparatuses can be used.

Other features which are considered as characteristic for the invention are set forth in the appended claims.

Although the invention is illustrated and described herein as embodied in an apparatus for processing and transferring mail, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 5:
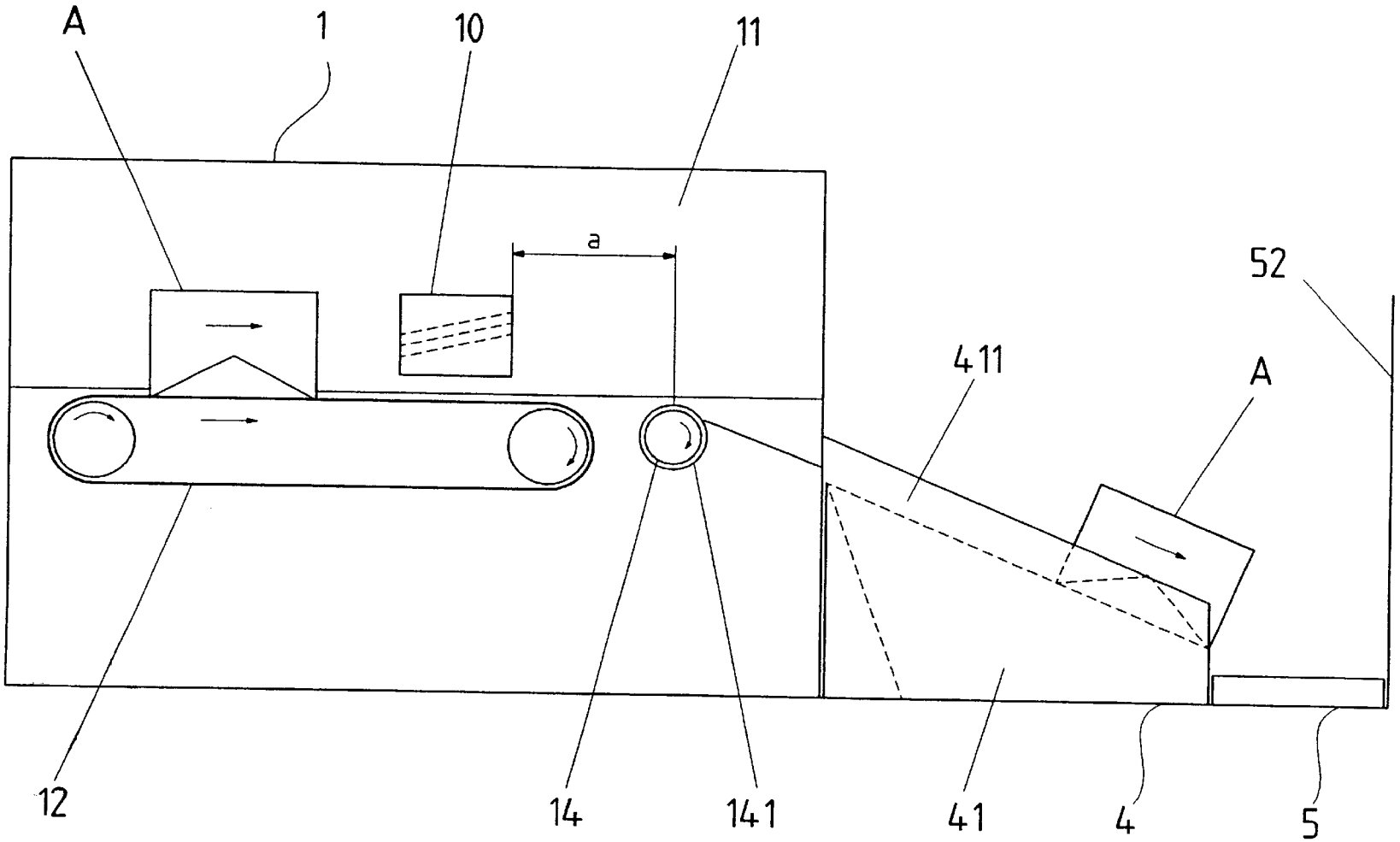
FIG. 5 is a basic diagram of the apparatus according to the invention with letters or envelopes transported on edge.

Referring now in detail to the figures of the drawings, which are in diagrammatic form in order to simplify matters and to aid understanding, and first, particularly, to FIG. 5 thereof, there is seen a franking machine 1 having a continuously circulating transporting belt 12 for transporting letters or envelopes A and a driven transporting roller 14 immediately downstream of the transporting belt 12, as seen in a transporting direction. As the letters or envelopes A run through the franking machine 1, they butt against a guide plate 11 and are printed through the use of an ink-jet printing head 10, which is immobile during printing operation. The ink-jet printing head 10 is spaced apart from the transporting roller 14 by an orthogonal distance a which is greater than the longest print or printed item which is to be expected. This ensures that a circumferential speed of the transporting belt 12, which speed is coordinated with a recording speed of the ink-jet printing head 10, is not affected by the transporting roller 14. A circumferential speed of the transporting roller 14 is set to be greater than that of the transporting belt 12, as a result of which the emerging letter or envelope A is accelerated. In order to assist the effect, the transporting roller 14 is provided with a covering 141 which has a correspondingly large coefficient of friction. A suitable polyurethane is the material which is preferably used.

Figure 6A:
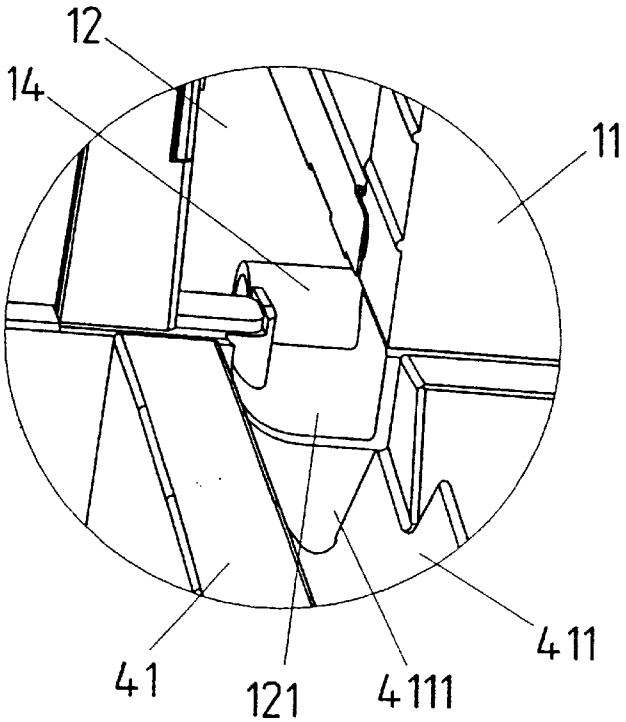
FIG. 6A is an enlarged, fragmentary, perspective view of a portion X of FIG. 6.

As is seen in FIG. 6A, a sliding surface 121 for a bottom edge of the letters or envelopes in the franking machine 1 downstream of the transporting roller 14 is at a somewhat lower level than an uppermost part of the transporting roller 14 and has a sloping configuration. Accordingly, as the letter or envelope A crosses over the transporting roller 14, it tips onto the sliding surface 121, is further accelerated as far as its end by the transporting roller 14 and, upon leaving the franking machine 1, it passes into a sloping channel 411 while still on edge. The channel 411 is formed in a front wall 41 of an angled insert 4 which, on one hand, is attached to the franking machine 1 and, on the other hand, is connected to a depositing box 5. A rear side wall 52, as seen in the transporting direction, is disposed orthogonally to the franking machine and is constructed as a resilient deflecting wall. The angled insert 4 also has a front wall 42 bordering a base 53 of the depositing box 5, as is seen in FIGS. 3 and 4.

Figure 3:
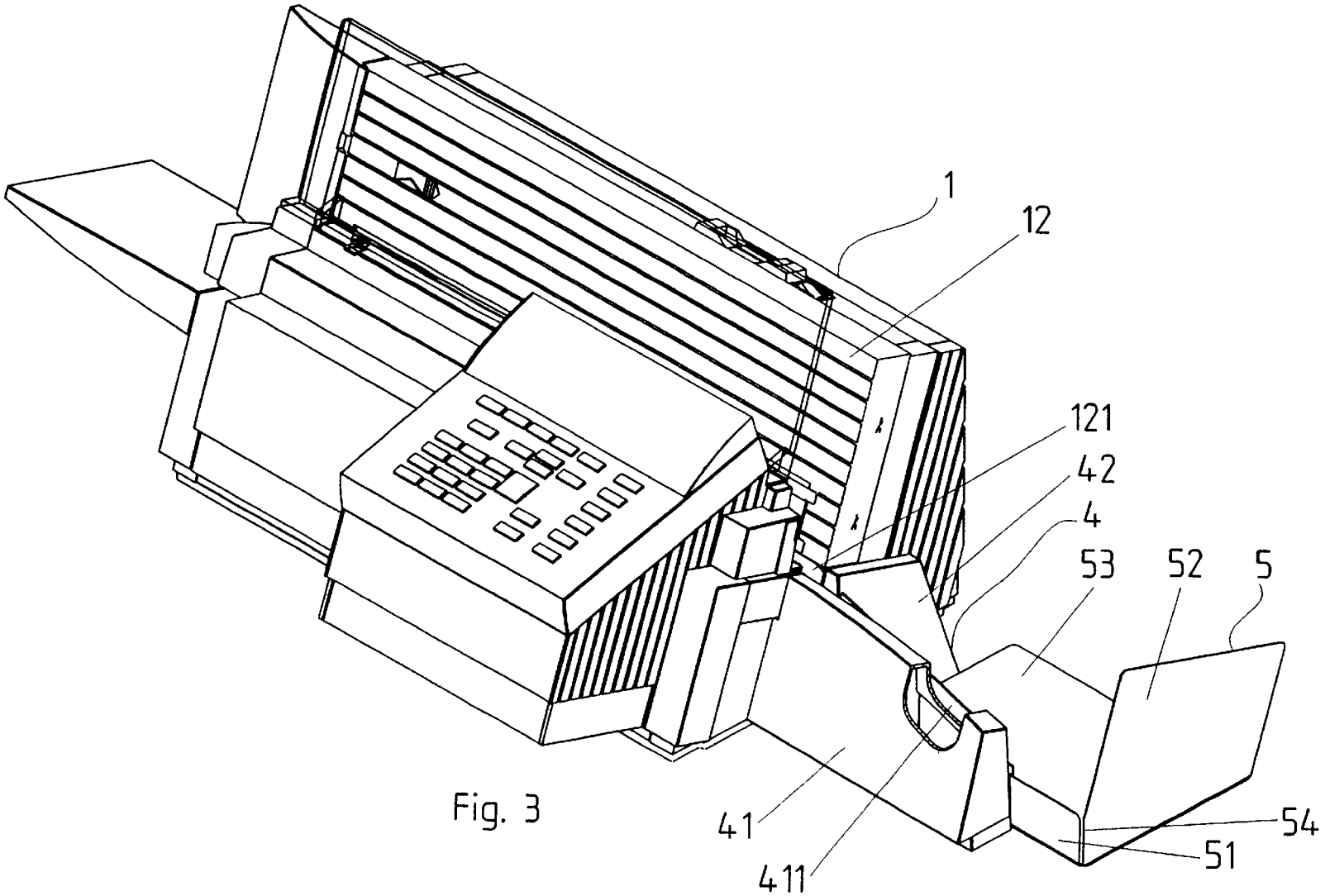
FIG. 3 is an enlarged, partly broken-away, right-side perspective view of a franking machine with a letter or envelope-depositing configuration according to German Published, Non-Prosecuted Patent Application DE 197 42 893 A1.
Figure 4:
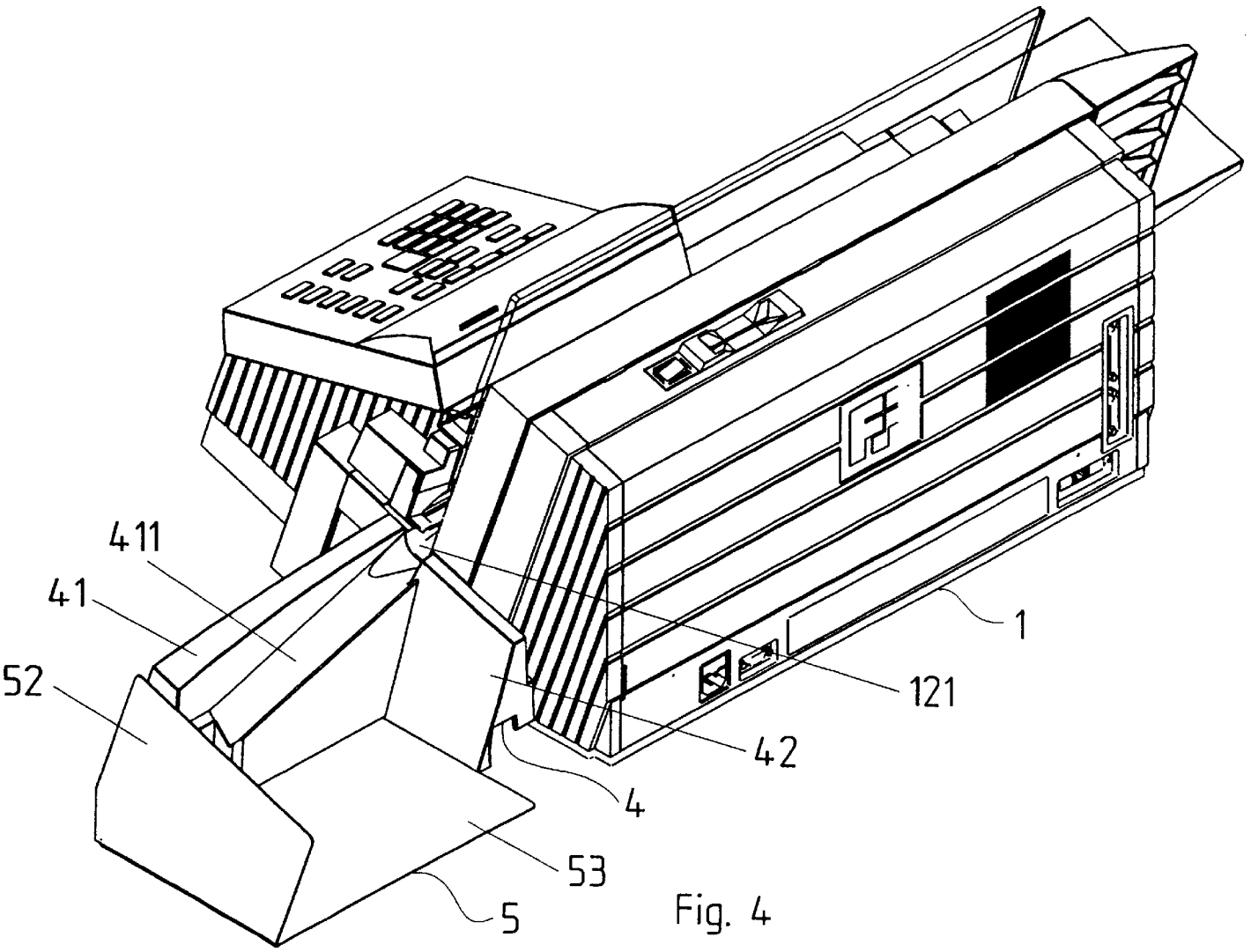
FIG. 4 is a right-rear perspective view of the apparatus according to FIG. 3.
Figure 6:
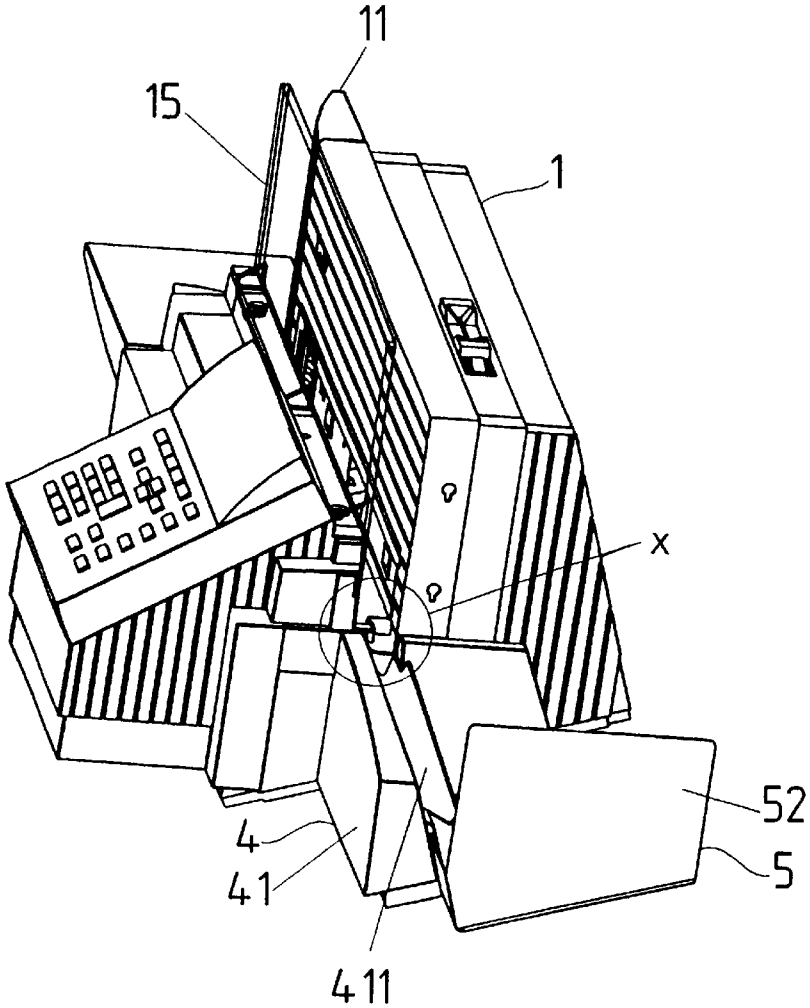
FIG. 6 is a reduced perspective view of the apparatus according to FIG. 3 with the apparatus according to the invention of FIG. 5.

FIGS. 6 and 6A illustrate the structure of the apparatus of the invention according to FIG. 5 in conjunction with FIGS. 3 and 4. In the franking and addressing machine 1, a clear plastic or PLEXIGLAS panel 15 is disposed opposite the guide plate 11 at a distance. This defines a shaft for guidance of the letter or envelope having a base which is formed by the transporting belt 12, the transporting roller 14 and the sloping sliding surface 121. The depositing box 5 is guided adjustably in the angled insert 4. The depositing box 5 is drawn out in accordance with the largest letter or envelope format which is to be processed. Since the letters or envelopes A are pre-positioned by the rearwardly inclined guide plate 11, they tip rearward, after striking against the rear side wall 52, over a rear top edge of the channel 411, into the depositing box 5. The slope and shape of the sliding surface 121 and an initial region 4111 of the channel 411 are adapted to one another.

Figure 1:
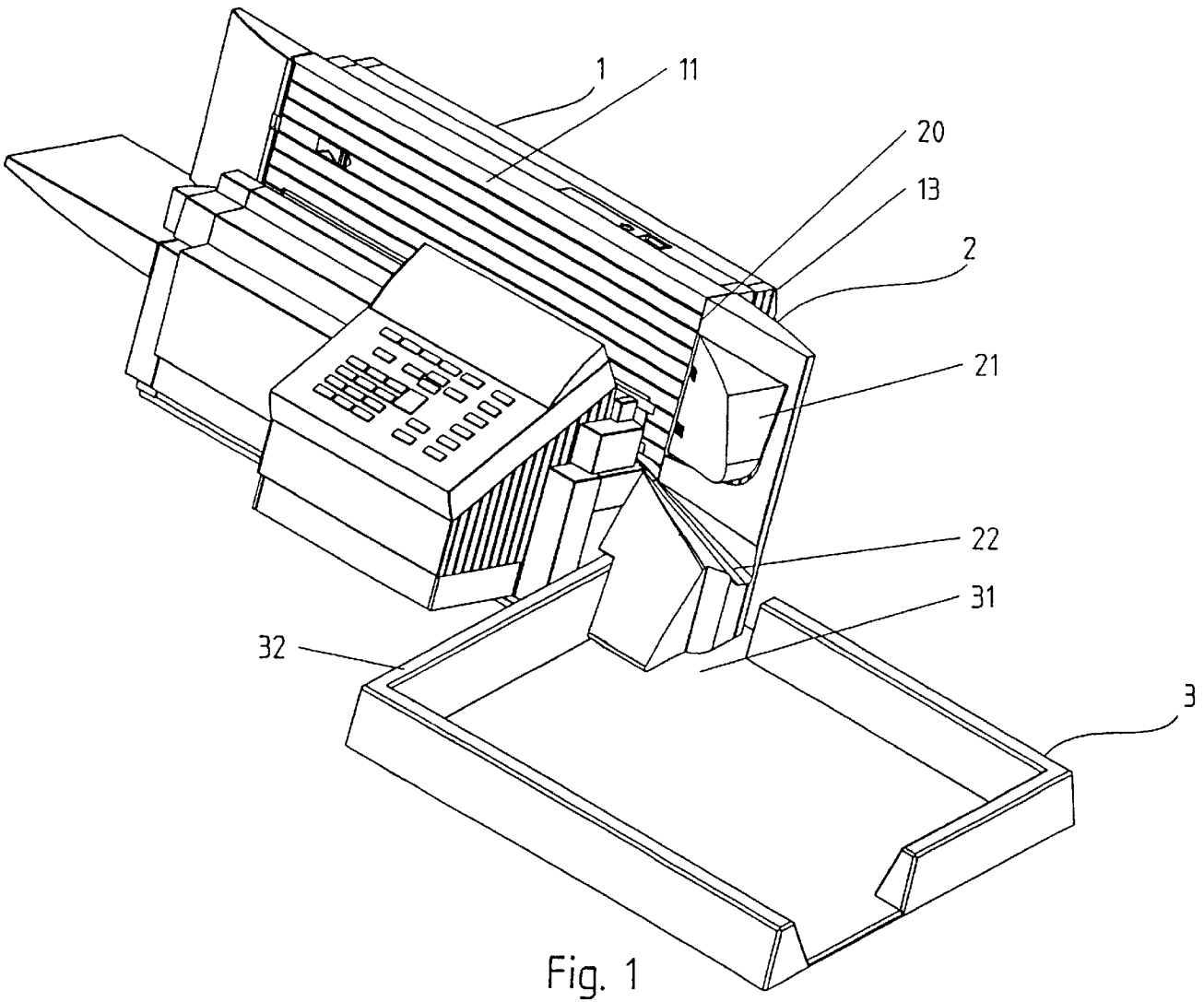
FIG. 1 is a diagrammatic, right-side perspective view of a franking machine with a letter or envelope-depositing configuration according to German Patent DE 197 05 089 C1.
Figure 2:
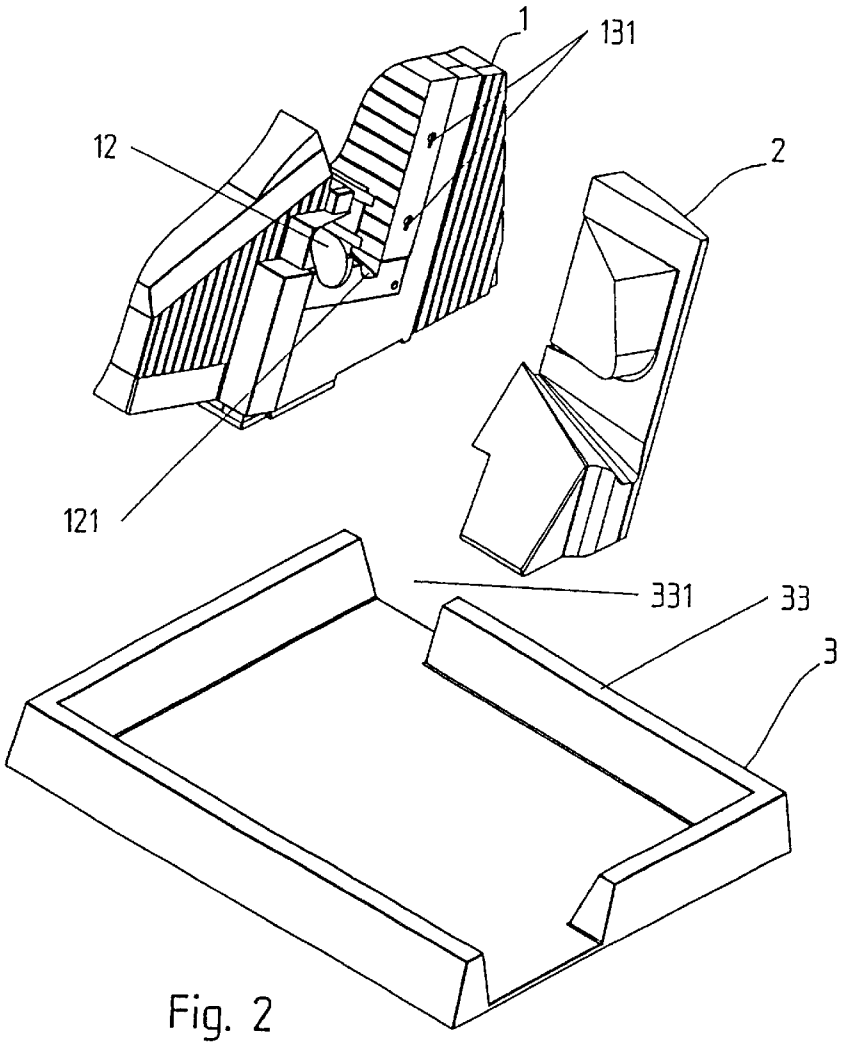
FIG. 2 is an exploded perspective view of portions of FIG. 1.

When a depositing apparatus according to FIGS. 1 and 2 is connected to the franking machine 1 equipped according to the invention, conditions are essentially analogous. In this case, however, a pivotable rocker 21 in an insert 2 causes the letters or envelopes to drop forward over a sloping channel 22 of the insert 2 onto a base 31 of a depositing box 3 having a side wall 33 and a front wall 32. The insert 2 is placed in an opening 331 of the depositing box 3 and has a wall 20 which is connected to a side wall 13 of the franking machine 1 by fasteners 131 in the form of keyholes in which the insert is fitted by way of corresponding cap pins.

Figure 7:
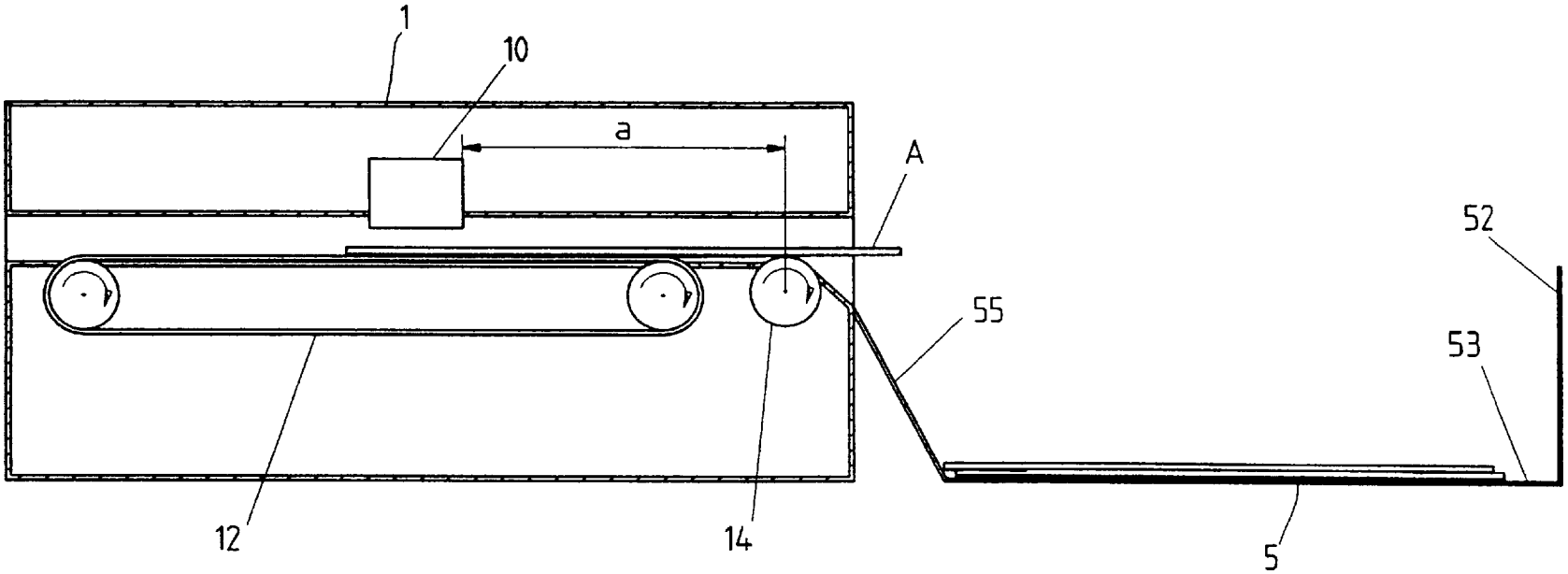
FIG. 7 is a basic diagram of the apparatus according to the invention with horizontal letter or envelope transportation.

A franking machine 1 illustrated in FIG. 7 also includes a continuously circulating transporting belt 12 transporting the letters or envelopes A and a driven transporting roller 14 immediately downstream of the transporting belt 12, as seen in the transporting direction. As the letters or envelopes A run through the franking machine 1, they are located horizontally on the transporting belt 12 and are printed through the use of an ink-jet printing head 10 which is disposed above the transporting belt and is immobile during printing operation. The ink-jet printing head 10 is spaced apart from the transporting roller 14 by an orthogonal distance a which is greater than the longest print or printed item which is to be expected. This ensures that a circumferential speed of the transporting belt 12, which speed is coordinated with a recording speed of the ink-jet printing head 10, is not affected by the transporting roller 14. In this case too, the circumferential speed of the transporting roller 14 is set to be greater than that of the transporting belt 12, as a result of which the emerging letter or envelope A is accelerated.

Figure 8:
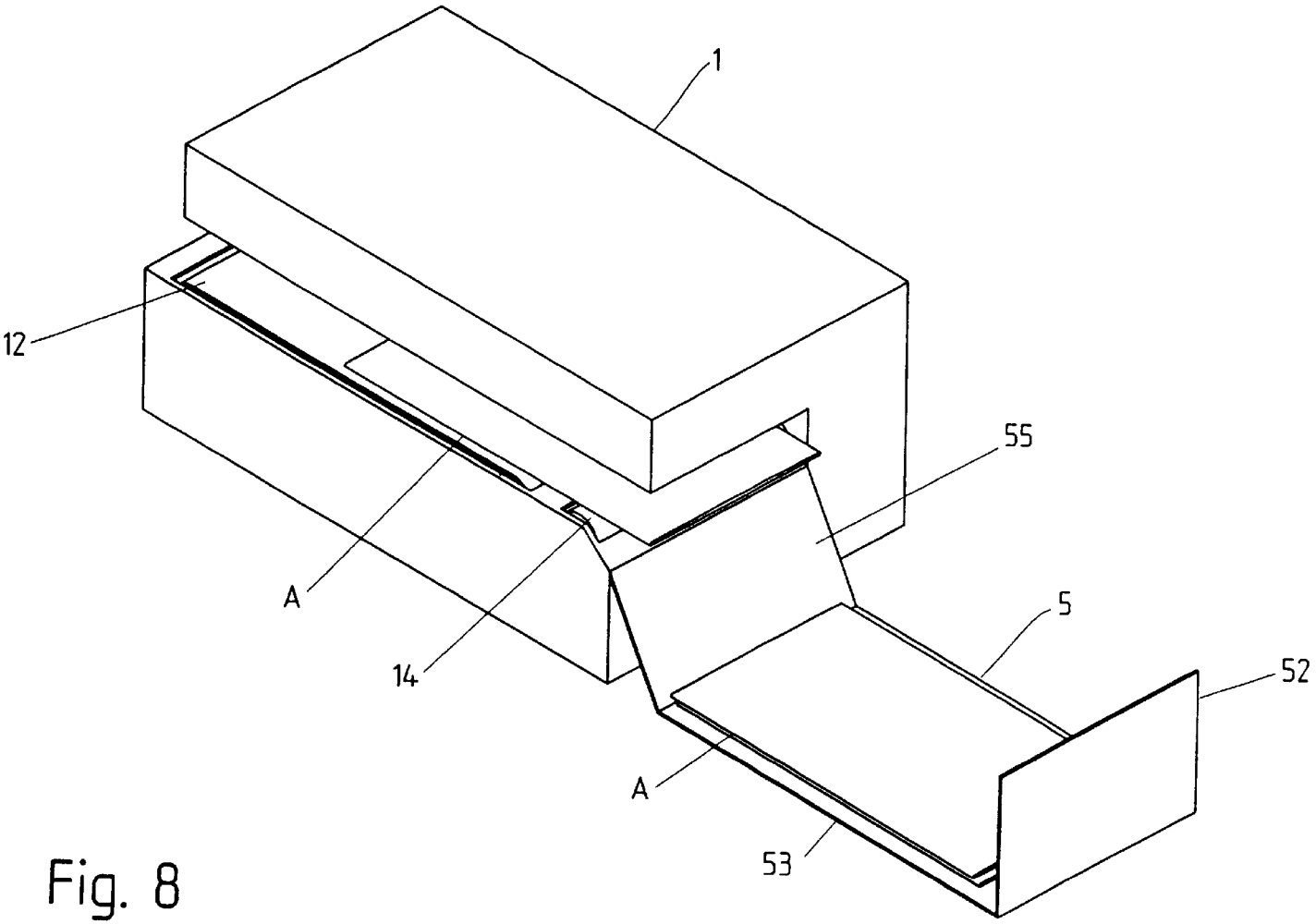
FIG. 8 is a basic perspective view of the apparatus according to FIG. 7.

A sliding surface for the letter or envelope A in the franking machine 1 downstream of the transporting roller 14 is at a somewhat lower level than an uppermost part of the transporting roller 14 and has a sloping configuration. Accordingly, as the letter or envelope A crosses over the transporting roller 14, it tips onto the sliding surface, is further accelerated as far as its end by the transporting roller 14 and, upon leaving the franking machine 1, it passes into a depositing box 5. A rear side wall 52, as seen in the transporting direction, is disposed orthogonally to the franking machine and is constructed as a resilient deflecting wall. The letter or envelope A slides, by way of its front edge, along a base 53 of the depositing box 5, or along a preceding letter or envelope A, until the front edge comes into contact with the side wall 52. A rear edge of the letter or envelope A slides down the front, obliquely running left-hand side wall 55 of the depositing box 5, as is also seen in FIG. 8.

I claim:

1. An apparatus for processing mail, such as letters, envelopes and cards, comprising:

a franking and/or addressing machine having a contactless printing device for printing items of mail including a longest item to be expected, a transporting device disposed at a given height and circulating at a given circumferential speed for transporting the items of mail in a transporting direction, a transporting roller disposed immediately downstream of said transporting device in the transporting direction, said transporting roller disposed at said given height and driven at a circumferential speed higher than said given circumferential speed, said transporting roller spaced apart from said printing device by an orthogonal distance greater than the longest item to be expected, and a lower-level sloping region disposed downstream of said transporting device in the transporting direction for receiving the items of mail; and a depositing apparatus disposed downstream of said sloping region for receiving and depositing the items of mail stackwise one above the other.

2. The apparatus according to claim 1, wherein said printing device is an ink-jet printing head.

3. The apparatus according to claim 1, wherein said transporting roller has a covering with a large coefficient of friction.

4. The apparatus according to claim 3, wherein said covering is formed of polyurethane.

5. The apparatus according to claim 1, including a rearwardly inclined guide plate against which the mail is transported on edge, said printing device disposed in the vicinity of said guide plate, and a sloping channel along which the mail slides down on edge in the transporting direction.

6. The apparatus according to claim 5, wherein said sliding region has an inclination and shape for a bottom edge of letters or envelopes in said franking and/or addressing machine, said sloping channel has an inclination and shape, and said inclinations and shapes of said sliding region and said sloping channel are adapted to one another.

7. The apparatus according to claim 6, wherein said depositing apparatus includes an insert and a depositing box, said sloping channel is part of said insert, and said depositing box is adjustable relative to said insert for adaptation to a largest letter or envelope format.

8. The apparatus according to claim 1, wherein said sliding region has a given inclination and shape, the mail is transported horizontally on said transporting belt, said printing device is disposed above said transporting belt, and said depositing apparatus includes a depositing box having a left-hand side wall adapted to said given inclination and shape and a right-hand side wall constructed as a deflecting wall.

* * * * *